United States Patent [19]

Yamanouchi et al.

[11] Patent Number: 4,976,036

[45] Date of Patent: Dec. 11, 1990

[54] ASSEMBLY FOR DETECTING AND RECORDING SURFACE CONTOUR DATA

[75] Inventors: Glenn T. Yamanouchi, Aiea; Stephen Orillo, Jr., Mililani Town, both of Hi.

[73] Assignee: The United States of America as represented by the Secretary of the Navy, Washington, D.C.

[21] Appl. No.: 429,732

[22] Filed: Oct. 31, 1989

[51] Int. Cl.[5] ..... B43L 13/10

[52] U.S. Cl. ..... 33/23.03; 33/41.5

[58] Field of Search ..... 33/41.5, 23.02, 23.03, 33/23.01, 41.1

[56] References Cited

U.S. PATENT DOCUMENTS

| | | | |
|---|---|---|---|
| 883,798 | 4/1908 | Gregory | 33/23.03 |
| 2,067,387 | 1/1937 | Gadd et al. | 33/41.5 X |
| 2,316,951 | 4/1943 | Graver | 33/23.03 |

FOREIGN PATENT DOCUMENTS

| | | | |
|---|---|---|---|
| 609845 | 6/1935 | Fed. Rep. of Germany | 33/23.03 |

*Primary Examiner*—Harry N. Haroian

*Attorney, Agent, or Firm*—William C. Townsend; Edward J. Connors, Jr.; Kenneth W. Dobyns

[57] ABSTRACT

A surface examination assembly for examining surface contours by detecting and recording surface contour data including profile data to determine the existence of variations of the surface from design specifications, and to determine the existence of structural degradation as indicated by surface contour changes includes a mounting frame for holding the assembly elements and for mounting the assembly on or near the surface to be examined, a probe arm adjustable mounted on the frame by means of a slide block, the slide block permitting movement of the probe arm in both a vertical and a horizontal position relative to the frame, a recording device for use with a recording medium mounted on the frame, the recording device being operatively engaged with the probe arm and moveable in response thereto to permit contour and profile data detected by the probe arm to be transmitted through the recording device to the recording medium. The assembly set includes alternate probe arms of differing shapes and sizes for use with different surface locations and contours and also includes alternative slide block extensions to permit adjustment of the assembly.

6 Claims, 1 Drawing Sheet

ASSEMBLY FOR DETECTING AND RECORDING SURFACE CONTOUR DATA

STATEMENT OF GOVERNMENT INTEREST

The invention described herein is assigned to the Government of the United States of America as represented by the Secretary of the Navy.

BACKGROUND OF THE INVENTION

This invention relates to testing assemblies and more particularly to a test assembly for detecting and recording surface contour data including profile data relating to the surface being examined.

In the periodic maintenance and repair of ships, particularly those employing nuclear power propulsion systems, there is frequently a requirement to inspect various surface contours and to detect, collect, and record various surface contour and profile data to determine whether the surface being inspected conforms to design specifications and to detect potential safety hazards such as structural degradation as indicated by surface contour or profile changes or pitting or deformation of surfaces such as weld joints and the like. The surfaces to be examined include interior and exterior hull sections, bulkhead, deck and other surfaces. In the past, such surface examination has required direct access to the surface by devices such as a hand-held or hand-operated linoleum gauge which is a device with multiple pins movably mounted in a holder. Application of the device to a surface sets the pins in a position reflecting a contour or profile of the surface being examined. Use of these types of devices required direct access to the surface being examined and frequently required human intervention at a location proximate to the surface.

Frequently the surfaces to be examined reside in locations to which it is difficult or impossible to obtain access either because other structural elements are located so as to block such access to the surfaces to be examined or because the surfaces are in a difficult or hostile environment such as under water or other contaminated fluid or in an area subject to radiation or chemical contamination thus rendering direct access to such surfaces difficult and dangerous. Heretofore surface examination in such circumstances has been very expensive, requiring expensive disassembly of obstructing structures or requiring the provision of expensive systems for protection against hostile environments.

It would be desirable to provide an assembly for examining surfaces which would be simple to operate, inexpensive to construct and which would obtain access to a surface to be examined to detect and record contour and profile data for surfaces to be examined without the need for human involvement in close proximity to such surfaces and without the need for expensive disassembly of obstructing structural elements.

SUMMARY OF THE INVENTION

The present invention provides a test assembly which is relatively inexpensive and which permits examination of surfaces located in remote or obstructed areas or in hostile environments to obtain contour and profile data and to record such data. The assembly includes a frame for mounting the assembly on a portion of the surface to be examined, or on a nearby support structure, a probe arm movably mounted on the frame by means of a slide block to permit scanning of the surface to be examined, a recording device connected to the probe arm though the slide block such that surface contour data detected by the probe arm is transmitted to the recording device, and a recording medium upon which the recording device makes a record of the surface contour data detected by the probe arm. The probe arm is actually one of a series of arms of different sizes and configurations which can be used alternatively depending upon the location and contour of the surface to be examined. In addition, the slide block provides vertical and horizontal movement of the probe arm and recording device and may include extension blocks to permit further adjustment and location of the probe arm relative to be surface to be examined.

It will be seen that the object of providing a test assembly which is inexpensive, simple to operate, and which permits detection and recording of surface contour data from a remote location without the need for proximate human involvement when the surface is located in a remote, obstructed, inaccessible or hostile location is achieved.

Other objects and advantages of the present invention will become apparent upon reading the following detailed description in conjunction with the preferred embodiment of the invention illustrated in the attached drawings.

While the present invention is described in conjunction with a preferred embodiment, it will be understood that it is not intended to be limited to that embodiment only, but rather to cover all alternatives, modifications and equivalents as may reasonably be included within the scope of this invention as described in the appended claims.

BRIEF DESCRIPTION OF DRAWINGS

In the accompanying drawings, in which is shown one of the various possible embodiments of the invention.

DESCRIPTION

Figure 1:
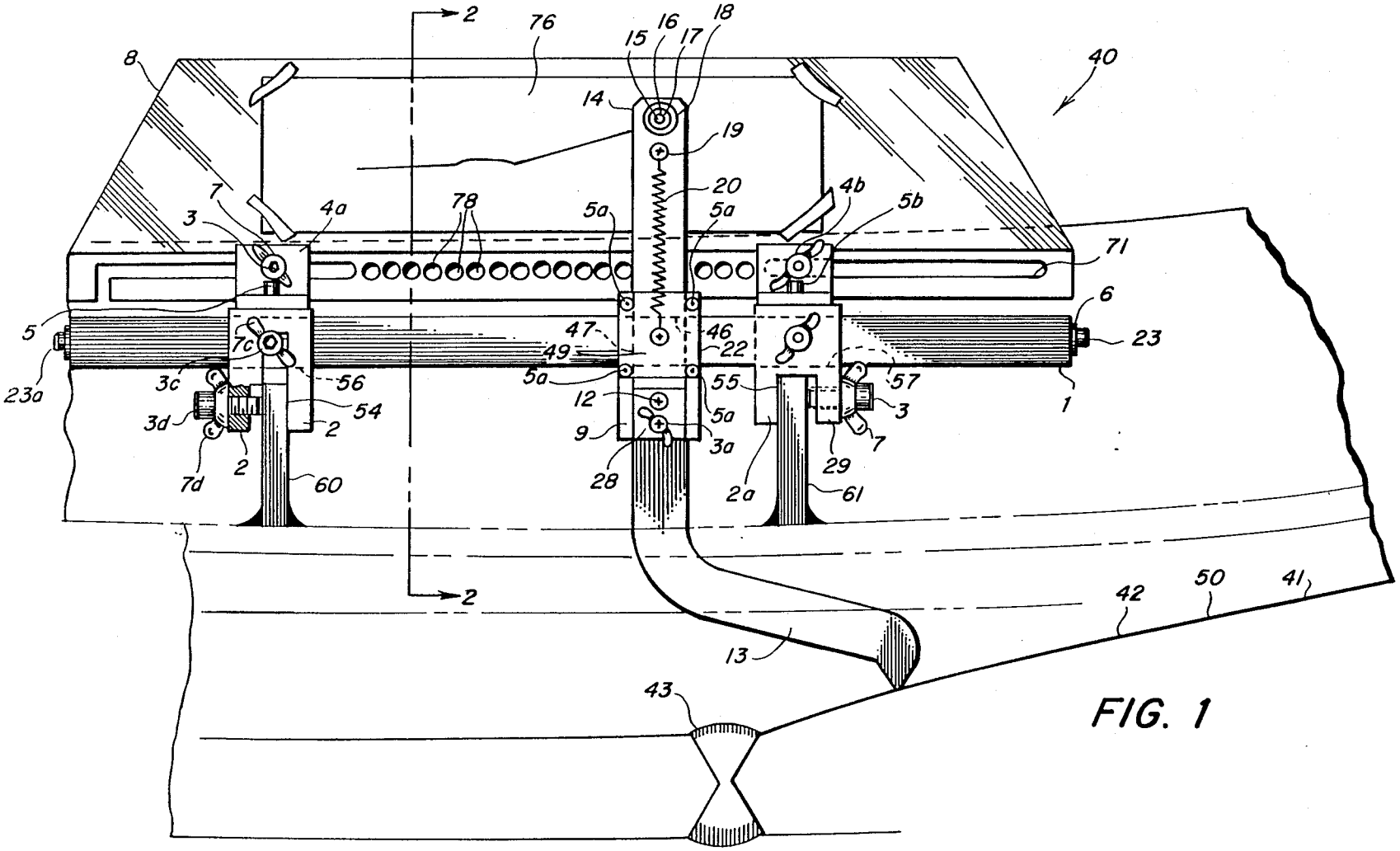
FIG. 1 is a plan view of a test assembly embodying the invention.

Referring now to the drawings, a surface examination assembly is shown generally at 40. A portion of a ship's hull 41 includes a surface 42 to be examined. Surface 42 includes, inter alia, a tapered portion 50 and a weld joint 43. In contact with surface 42 is a probe arm 13 which is designed to scan surface 42 in order to detect the contour or profile of surface 42. Scanning surface 42 provides data from which it can be determined whether the contour of surface of 42 meets design specifications as well as to detect deterioration or degradation of the surface or structure under the surface, for example pitting of the surface of weld joint 43 or bulging of the surface 42. Access to the surface 42 is obstructed by an additional portion of the ships structure 44 except for a narrow opening 45. Previously, examination of surface 42 in such circumstances would require disassembly and removal of structural member 44 to permit direct access to surface 42 so that a device such as a hand-held linoleum gauge can be used to determine contour and profile data for surface 42. Employing assembly 40 permits examination of surface 42 from a remote location without the necessity of human intervention in close proximity to surface 42.

Probe arm 13 is made of thin gauge steel and is one of a set or series of probe arms of differing sizes and configurations. The appropriate size and configuration of probe arm 13 is selected based on the location and access to the portion of surface 42 to be examined as well as the contour of surface 42. Determining this location and degree of access can be done by an alignment or sensing arm used in place of arm 13 to sense surface portion 42. Having selected the appropriate size probe arm, the probe arm 13 is attached to a scribe arm 14 through block extensions 21 and 27 which are employed to permit adjustment of the location of probe arm 13 relative to the rest of assembly 40 and surface 42. Probe arm 13 is retained through lock plate 28 by means of screw 3*a* and wing nut 7*a*. If necessary an additional screw 12 can be employed for additional rigidity. It will be understood that block extensions 21 and 27 are selected from a series of such extensions of varying size to adjust the location of scribe arm 14 to a desired position.

Scribe arm 14 has mounted at one end thereof, a writing instrument 46 which is attached to arm 14 by means of a holder 15, compression spring 16, bushing 17, and compression ring nut 18. Holder 15 is cylindrical with an internal diameter sized to accept a writing instrument and an external diameter sized to be received within spring 16 and bushing 17. A tapered end of holder 15 fits within an opening in the end of arm 14 and is retained therein by ring nut 18.

The other end of scribe arm 14 is slidably mounted within a vertical slot 47 in slide block 9 and is retained therein by a retainer cover plate 22 held by screws 5*a*. Slide block 9 includes a horizontal slot 48 on the opposite side of block 9 from vertical slot 47 for slidably mounting block 9 on a track in the form of a slide bar 1. Block 9 is retained on slide bar 1 by cover plate 10 secured by screws 5*b*. Slide bar 1 includes at each of its ends a travel limit stop discs 6*a* which are retained by screws 23 and 23*a*, respectively. Slide block 9 is mounted on slide bar 1 to permit horizontal sliding movement in response to movement of arm 13.

Scribe arm 14 moves vertically within slot 47 of block 9 in response to movement of arm 13 and is tension controlled by means of coil spring 20 which has one end attached to the upper end of scribe arm 14 by means of screw 19 and has its other end attached to cover plate 22 at screw 49. Coil spring 20 thus operates to maintain pressure on scribe arm 14 and arm 13 to insure good contact between arm 13 and surface 42. Movement of slide block 9 along slide bar 1 causes arm 13 to scan surface 42 to examine its contour or profile.

A pair of block clamps 2 and 2*a* have upper U shaped slots 56, 57 and lower U shaped slots 54, 55 arranged transversely to each other. An image receiving board is mounted through brackets 4*a* and 4*b* and screws 5 and 5*b* on blocks 2 and 2*a* respectively. Each block 2 and 2*a* is secured to slide bar 1 which is seated in upper slots 56 and 57 and secured by screw and wing nut fasteners 3*c* and 7*c*. As shown in FIG. 1, the lower slots 54 and 55 engage a portion of the ship hull structures 60 and 61 and are secured by screw and wing nut arrangement 3 and 7.

Figure 2:
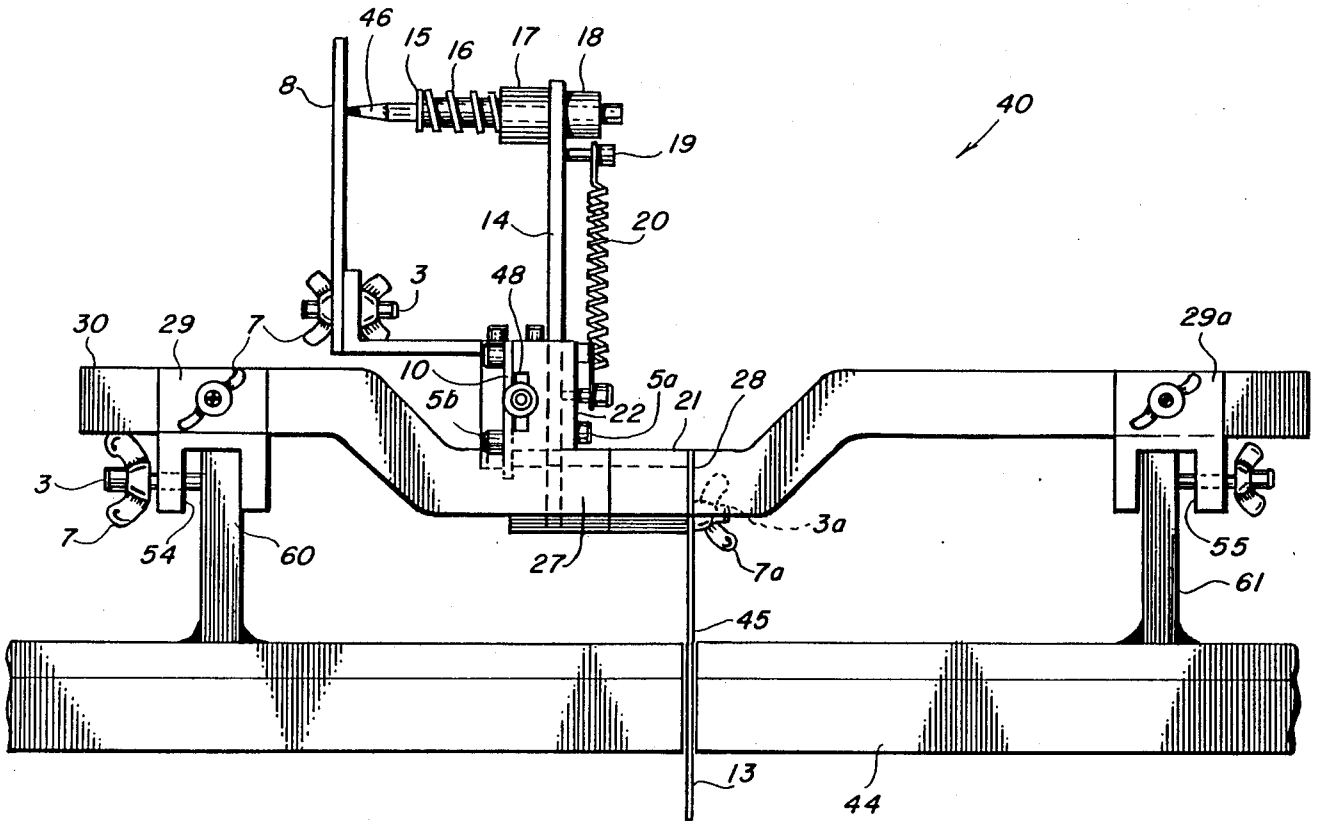
FIG. 2 is a view along a line A—A of FIG. 1 with portions broken away or omitted and showing an alternate mounting arrangement.

An alternate mounting arrangement is shown in FIG. 2 in which blocks 2 and 2*a* are mounted on offset bar 30 by screw and wing nut fasteners 3 and 7 and offset bar 30 is in turn mounted on structure 60 and 61 by block clamps 29 and 29*a* which are similar to block clamps 2 and 2*a*.

Board 8 is employed as a mounting for an image receiving and recording chart 76 with which writing device 46 is in contact in order to receive and record contour and profile data relating to surface 42. Board 8 includes slots 71 and multiple mounting holes 70 located on a common line and arranged to permit adjustable mounting of the board 8 on brackets 4*a* and 4*b*. Thus the board 8 can be adjusted to a desired position to receive data from writing device 46.

It can be seen that in operation, movement of arm 13 relative to surface 42 is transmitted through slide block 9 to scribe arm 14 thru writing device 46 where it is transmitted to and recorded on chart 76. In this manner a surface 42 which is to be examined can be scanned by a probe arm 13 from a location remote from surface 42. Contour and profile data relating to the surface 42 including indications of degradation of weld surface 43 or deviations from design specifications can be detected and transmitted through scribe arm 14 and writing device 46 to be recorded on chart 76.

Adjustment of and location of arm 13 relative to surface 42 and opening 45 can be achieved by selecting the appropriate size and configuration of arm 13 and extension 21. Further adjustment can be made by adjusting the location of board 8 through slots 71 and mounting hole 70. Finally orientation of the assembly 40 relative to surface 42 can be achieved through the alternate mounting arrangement of FIG. 2 in which bar 30 and blocks 29 and 29*a* are employed to mount the device.

What is claimed is:

1. An assembly for detecting and recording contour data relating to a surface to be examined including a probe arm having a first end in contact with the surface for scanning the surface to detect contour data, a slide block having a first slot therein running in a direction generally horizontal to the surface to be examined and a second slot running in a direction generally vertical to the surface to be examined, a scribe arm slidably mounted in the second slot, a first end of the scribe arm being connected to a second end of a probe arm so that vertical movement of the probe arm results in vertical movement of the scribe arm, a writing device mounted on the second end of the scribe arm, a slide bar arranged to receive the first slot of the slide block to permit relative sliding movement therebetween, at least one clamp block having an upper end on which the slide bar is mounted and a lower end for mounting the assembly in a location relative to the surface to permit scanning of the surface by the probe arm, and an image receiving board mounted on the clamp block and in contact with the writing device to receive and record contour data detected by the probe arm.

2. An assembly as set forth in claim 1 including a plurality of mounting holes and slots in the image receiving board and arranged to permit adjusting the location of the board.

3. An assembly as set forth in claim 1 including a second block clamp for mounting the assembly on a bar running in a direction generally perpendicular to the slide bar.

4. An assembly as set forth in claim 1 in which the connection between the probe arm and the scribe arm includes at least one removable extension block to permit adjustment of the location of the probe arm.

5. An assembly as set forth in claim 1 in which the probe arm is one of a series of probe arms of differing sizes and shapes which can be used interchangeably one at a time and selected so as to permit the probe arm to be located in contact with the surface to be examined.

6. An assembly as set forth in claim 1 including a tension spring one end of which is attached to the second end of the scribe arm and the other end of which is attached so as to urge the probe arm against the surface to be examined.

* * * * *